United States Patent [19]

Kurosawa et al.

[11] 4,336,430

[45] Jun. 22, 1982

[54] VACUUM INTERRUPTER

[75] Inventors: Yukio Kurosawa; Yukio Kawakubo, both of Hitachi; Nobuo Abe, Tokaimura, all of Japan

[73] Assignee: Hitachi, Ltd., Tokyo, Japan

[21] Appl. No.: 96,386

[22] Filed: Nov. 21, 1979

[30] Foreign Application Priority Data

Nov. 22, 1978 [JP] Japan ..... 53-143392

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,935,406 | 1/1976 | Murano et al. | 200/144 B |
| 3,946,179 | 3/1976 | Murano et al. | 200/144 B |
| 4,196,327 | 4/1980 | Kurosawa et al. | 200/144 B |
| 4,210,790 | 7/1980 | Kurosawa et al. | 200/144 B |

*Primary Examiner*—Robert S. Macon

*Attorney, Agent, or Firm*—Craig and Antonelli

[57] ABSTRACT

A vacuum interrupter comprises a pair of electrodes separably arranged within a vacuum vessel and mounted on conductor rods respectively. Each of the electrodes includes a coil electrode and a main electrode. The coil electrode is adapted to branch the current in the conductor rod in different radial directions with respect to the conductor rod for generating magnetic fields in axial direction of said conductor rod in such a manner as to offset each other at points near to the conductor rod. The main electrode is electrically connected with the coil electrode for carrying an arc. The main electrode includes a plurality of first current paths for passing the current in different radial directions, a plurality of second current paths for passing the current from the coil electrode to the first current paths, and a plurality of third current paths for passing the current therein in opposite directions to the current in the second current paths. Magnetic fields are generated in the main electrode in the same axial direction as those generated in the coil electrode, with the result that the arc is extinguished quicker when compared with the case where only one of the main and coil electrodes generates the axial magnetic field, thus improving the current-interrupting performance.

14 Claims, 5 Drawing Figures

VACUUM INTERRUPTER

The present invention relates to a vacuum interrupter comprising an opposed pair of coil electrodes for generating magnetic fields in axial direction and a pair of main electrodes electrically connected to the pair of coil electrodes respectively, both types of electrodes being arranged in a vacuum vessel, in which the arc started at the main electrodes is extinguished by the axial magnetic fields and the main electrodes have improved current paths.

Generally, a vacuum interrupter comprises a pair of electrodes mounted on conductor rods respectively in opposed relation within a cylindrical vacuum vessel. The electrode pair normally conducts current in closed condition. In the event of an accident in an external circuit, however, the electrodes are separated from each other to prevent damage to the devices. The arc generated between the electrodes at that time must be extinguished as early as possible. Recently, an arc quenching method has been disclosed by British Pat. No. 1,478,702 in which a vacuum interrupter is so constructed that a magnetic field is applied in axial direction of the conductor rod, i.e., in parallel to the arc so that the arc is extinguished by being dispersed into numberless thin forms.

Each of these electrodes carries a coil electrode mounted on a conductor rod. The coil electrode includes a plurality of arms for branching current in the conductor rod to radial directions of the conductor rod and an arcuate section for passing the current in the arms along the circumference thereof thus generating axial magnetic fields extending to the axial direction of the conductor rod. Part of the arcuate section is connected electrically to the main electrode for carrying the arc. The main electrode has a plurality of slits formed at parts thereof substantially corresponding to those portions of the coil electrode in the direction from the arcuate section toward the conductor rod. The slits reduce the area in which eddy current is generated in the main electrode by the axial magnetic fields, thus preventing the axial magnetic fields from being reduced.

In this electrode structure, however, the magnetic field caused by the current flowing in radial directions through the arms is offset by the magnetic field caused by the current flowing along the slits, with the result that the axial magnetic fields in the axial direction are generated only by the current at the arcuate portion. The increase in axial magnetic field to prompt arc extinction for a sharp increase in the interruption characteristics is thus naturally limited.

This is also the case with the invention disclosed in the U.S. Patent application Ser. No. 857,706 filed by the inventors, in which slits are formed in the main electrode electrically connected with the coil electrode for generating axial magnetic fields in different directions.

Accordingly, it is an object of the present invention to provide a vacuum interrupter with the breaking characteristics improved by increasing the axial magnetic fields.

In order to achieve the above-mentioned object, according to the present invention, there is provided a vacuum interrupter in which current paths for passing the current in the same direction as that in the coil electrode are formed in the main electrode, so that axial magnetic fields are generated also by the main electrode for increased magnetic fields, thus improving the interrupting characteristics.

The above and other objects, features and advantages will be made apparent by the detailed description taken in conjunction with the accompanying drawings, in which.

Figure 1:
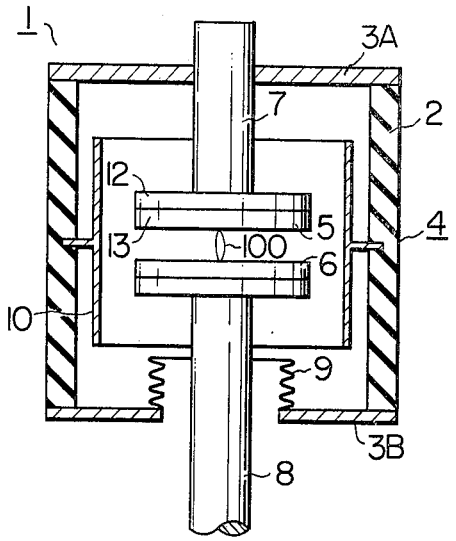
FIG. 1 is a cross sectional view of the vacuum interrupter according to an embodiment of the present invention.

In the vacuum interrupter shown in FIG. 1, a cylindrical insulating casing 2 and metal end covers 3A and 3B closing both sides of the insulating casing 2 make up a vacuum vessel 4. A fixed electrode 5 and a movable electrode 6 which are opposed in a separable fashion from each other are arranged in the vacuum vessel 4. Conductor rods 7 and 8 extend to the exterior of the vacuum vessel 4 from the rear sides of the electrodes 5 and 6 respectively. A metal bellows 9 is provided between the conductor rod 8 and the end cover 3B and is movable in axial direction in such a manner as to separate the movable electrode 6 from the fixed electrode 5 thereby to close or open the gap between the movable electrode 6 and the fixed electrode 5. A metallic intermediate shield 10 is mounted on the inner walls of the insulating cylinder to surround the two electrodes.

The detailed construction of the fixed electrode 5 and the movable electrode 6 will be explained with reference to FIGS. 2 and 3 in which a description is given only of the fixed electrode since both electrodes have the same construction.

The fixed electrode 5 includes a coil electrode 12 mounted on the conductor rod 7 and a main electrode 13.

The coil electrode 12 comprises first arms 14A and 14B each having one end connected to the conductor rod 7 and extending radially from the conductor rod, an annular current dividing section 15 connected with the other end of each of the first arms 14A and 14B, a spacer 17 mounted on the top of the conductor rod 7 connected with the first arms 14A and 14B, and protrusions 18 and 19 each formed midway of the current dividing section 15 between the portions A and B thereof connected to the arms 14A and 14B on the same side of the spacer 17. The spacer 17 is made of such material as stainless steel or ceramics for blocking current flow. The main electrode 13 for carrying a spark 100 is fixed on the spacer 17 and the protrusions 18 and 19.

The main electrode 13 comprises a plurality of communicating current paths including first current paths 21, 22 and second and third current paths 23 and 24. The first current path 21 has one end thereof connected to the protrusion 18 electrically and the other end thereof connected with the center of one side of the second current path 23 in the form of a main current path having the second current path portions **23*a* and 23*b* extending toward the outer periphery from the center 0 of the main electrode 13. The other first current path 22 is connected at its one end with the center of the other side of the second current path 23 in opposed relation with the current path 21, and has the other end connected with the protrusion 19. The outer ends of the first current paths 21 and 22 are arranged in opposition relation to each other with respect to the second current paths 23. The third current paths 24 form dispersed current paths which include four portions E, F, G and J oriented in the same direction adjacently to the first current path 21 through the slits 25***a* and 25*b* and to the first current path 22 through the slits 25*c* and 25*d*. One end of each of the third current paths 24 is connected with the second current path 23. In addition to the slits 25*a*, 25*b*, 25*c* and 25*d*, two slits 26 and 27 are formed in each of the four portions E, F, G and J to provide other third current paths 28 and 29 for dispersing the current flowing into the third current path 24. In place of the slit 25, a high-resistance member made of such material as stainless steel or ceramics may be used for blocking the current flow. Namely, any material which can block the current flow may alternatively be used.

Next, the functions of the main electrode 13 will be explained below.

When the movable electrode 6 is separated from the fixed electrode 5 by a control device not shown, the arc 100 is generated between the main electrodes 13 of the electrodes 5 and 6.

Figure 2:
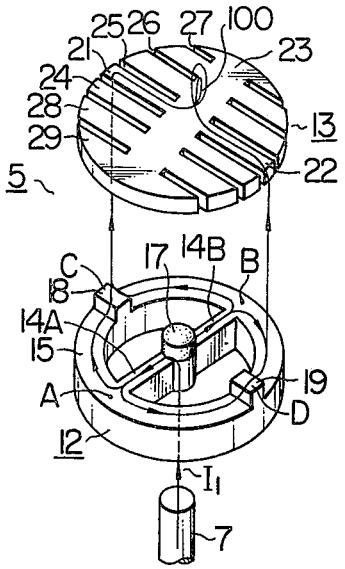
FIG. 2 is a perspective view of the electrode used in the embodiment of FIG. 1.
Figure 3:
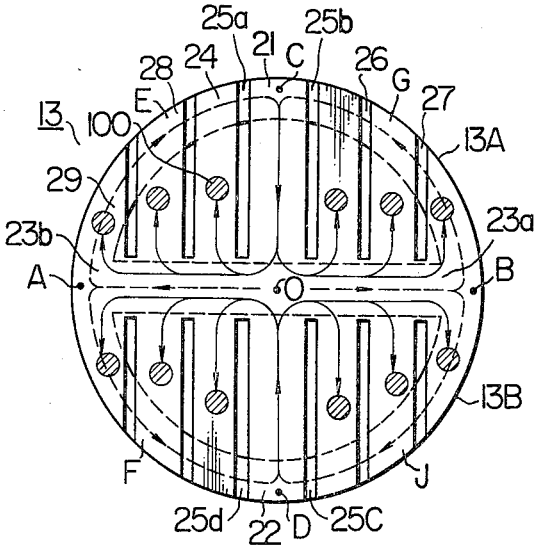
FIG. 3 is a plan view showing the main electrode of FIGS. 1 and 2 in detail.

On the other hand, the current $I_1$ in the conductor rod 7 flows into the first arms 14A and 14B in different radial directions from the conductor rod 7 as shown by the arrows in FIGS. 2 and 3. The current in the first arms 14A and 14B flows into the current-dividing section 15 and is divided in opposite directions at the current-dividing points A and B, and these currents merge at points C and D, and thereafter flow into the first current paths 21 and 22.

Figure 4:
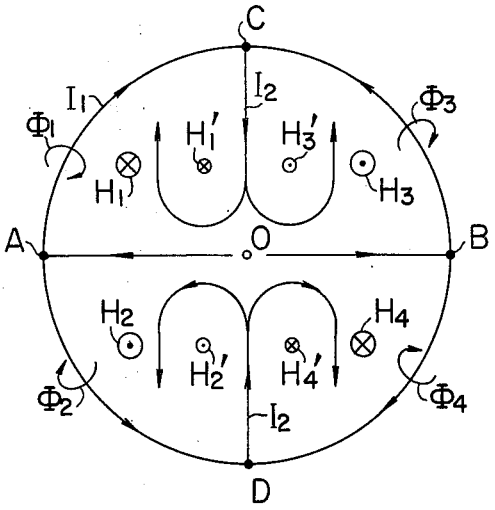
FIG. 4 is a diagram for explaining the loci of the currents flowing the electrode of FIG. 2.

The loci of these current flows will be explained with reference to FIG. 4. The current I is divided at the point O and the divided current $\frac{1}{2}\cdot I$ flows in the radial directions OA and OB respectively. At each of the points A and B, the current component $\frac{1}{2}\cdot I$ is divided into currents $\frac{1}{4}\cdot I$, which reach points C and D, where they again merge, with the result that current components $\frac{1}{2}\cdot I$ flow into the first current paths 21 and 22. The magnetic fluxes $\Phi_1$, $\Phi_2$, $\Phi_3$ and $\Phi_4$ generated by these oppositely flowing currents divided at the points A and B in the current dividing sections 15 form magnetic fields $H_1$, $H_2$, $H_3$ and $H_4$ extending in the axial direction of the conductor rod. The axial magnetic fields $H_1$, $H_4$ are so directed as to cancel the axial magnetic fields $H_2$, $H_3$ at the center of the coil electrodes.

As shown in FIG. 3, each of currents $I_2$ in the first current paths 21 and 22 flows into the corresponding third current paths 24 through the second current paths 23. The current in each of the third current paths 24 flows in the direction opposite to the current in the first current path. The currents $I_2$ thus follow a locus as shown in FIG. 4. The current $I_2$ makes the same locus as the current $I_1$ in the coil electrode 12. As a result, axial magnetic fields $H_1'$, $H_2'$, $H_3'$ and $H_4'$ are generated in the main electrode 13 in the same direction as the axial magnetic fields $H_1$, $H_2$, $H_3$ and $H_4$ in the coil electrode 12 respectively. Thus the arc 100 is acted on by the axial magnetic fields of both the main electrode and the coil electrode and therefore is quenched quicker, thereby improving the breaking performance greatly when compared with the action by the axial magnetic fields of either the main electrode or the coil electrode alone.

It is seen from FIG. 3 that the main electrode 13 has an upper semicircular portion 13A formed with the slits 25, 26 and 27 in the same direction and a lower semicircular portion 13B formed with similar slits in the same direction but in opposed relation to the slits 25, 26 and 27 respectively. The slits in one semicircular portion are thus cut only by making a half revolution of the main electrode after formation of the slits in the other semicircular portion, thereby facilitating the manufacture thereof.

Figure 5:
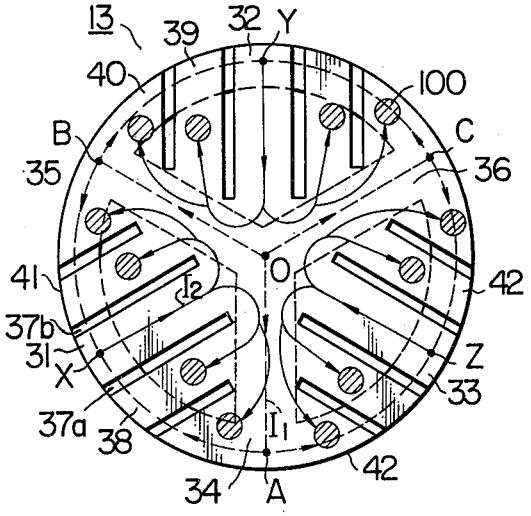
FIG. 5 is a plan view of the main electrode according to another embodiment of the present invention.

Another embodiment having current paths different from those in the main electrode 13 of the preceding embodiment is shown in FIG. 5. The coil electrode shown by dashed lines comprises three first arms extending radially from the conductor rod at intervals of 120 degrees toward the current dividing section 15. The current $I_1$ in the first arms is divided in opposite directions at points A, B and C respectively and the divided current components merge at points X, Y and Z respectively, thereafter flowing into the main electrode 13. Three first current paths 31, 32 and 33 shown by solid lines with one end thereof connected with the points X, Y and Z respectively extend in radial directions at intervals of 120 degrees between adjacent two first arms respectively. The other end each of the first current paths is connected with three second current paths 34, 35 and 36 respectively disposed correspondingly to the three first arms. The third current paths 38 and 39 are formed adjacent to the first current paths 31, 32 and 33 through the slits 37*a* and 37*b* respectively. The current $I_2$ in the first current paths 31, 32 and 33 flows in the direction of the arrow of solid lines and functions in a similar manner to the current $I_2$ in the preceding embodiment. In this embodiment under consideration, however, the arcuate sections, say, 40, 41 and 42 formed respectively between the second current paths 35 and 36, between 35 and 34 and between 34 and 36 have the same area.

It will be understood from the foregoing description that according to the present invention, the main electrode has the first, second and third current paths having the same current loci as those in the coil electrode, and therefore axial magnetic fields similar to those in the coil electrode are generated in the main electrode. As a result, the extinction of the arc is quickened, thus greatly improving the interrupting performance.

What is claimed is:

1. A vacuum interrupter including a vacuum vessel, a pair of electrode assemblies arranged separably with respect to each other in said vacuum vessel, and conductor rods on which said pair of electrode assemblies are mounted respectively, each of said electrode assemblies including a coil electrode and a main electrode, said coil electrode including arms for branching the current flowing in said conductor rod to a plurality of different radial directions with respect to said conductor rod, said coil electrode further including a current dividing section for branching the current flowing in each of said arms in different circumferential directions with respect to said conductor rod thereby generating axial magnetic fields in different directions, said main electrode being electrically connected to said current dividing section, wherein said main electrode comprises at least two main electrode sections, each of said main electrode sections including:

(a) a first current path with an end thereof electrically connected to said current dividing section for passing the current from said current dividing section toward said conductor rod, (b) a plurality of second current paths each having one end thereof connected to said first current path for branching the current in said first current path from said conductor rod side toward said current dividing section side, and (c) a plurality of third current paths each having one end thereof connected to said associated second current path for passing the current in said associated second current path to the direction in parallel and opposite to the current in said first current path.

2. A vacuum interrupter according to claim 1, wherein said main electrode comprises two first current paths arranged in opposed relation to each other with said second current path therebetween, and a plurality of third current paths each arranged adjacently to said associated first current paths with a current blocking means therebetween.

3. A vacuum interrupter according to claim 1 or 2, wherein said third current paths are formed on both sides of said associated first current path.

4. A vacuum interrupter according to said claim 3, wherein said third current path is formed into a plurality of current paths by a plurality of current-blocking means.

5. A vacuum interrupter according to claim 4, wherein said current-blocking means is made of a high-resistance material.

6. A vacuum interrupter according to claim 4 wherein said current-blocking means is a slit.

7. A vacuum interrupter according to claim 2, wherein said third current path is formed into a plurality of current paths by a plurality of current-blocking means.

8. A vacuum interrupter according to claim 2, wherein said current-blocking means is made of a high-resistance material.

9. A vacuum interrupter according to claim 2, wherein said current-blocking means is a slit.

10. A vacuum interrupter including a vacuum vessel, a pair of electrode assemblies arranged separably with respect to each other in said vacuum vessel, and conductor rods on which said pair of electrode assemblies are mounted respectively, each of said electrode assemblies including a coil electrode and a main electrode, said coil electrode including arms for branching the current flowing through said conductor rod into a plurality of different radial directions with respect to said conductor rod, said coil electrode further including a current dividing section for branching the current flowing through each of said arms in different circumferential directions of said coil electrode with respect to said conductor rod thereby generating axial magnetic fields in different directions, said main electrode being electrically connected with said current dividing section and being connected to a portion of said arms corresponding to said conductor rod through a spacer of high-resistance material, wherein said main electrode comprises:

(a) a plurality of main current paths extending from a central portion of said main electrode in different radial directions thereof;

(b) a plurality of current blocking sections provided between each of said main current paths and the circumferential end of said main electrode; and (c) a plurality of dispersed current paths provided between respective adjacent pairs of said current blocking sections and between said current blocking sections and said circumferential end, said dispersed current paths including communicating current paths formed so as to connect between end portions of said main current paths and circumferential end portions of said main electrode electrically connected to said current dividing section.

11. A vacuum interrupter according to claim 10, wherein said main electrode includes at least two of said main current paths extending from the central portion of said main electrode in different radial directions thereof, at least two arc portions each having substantially the same area and sandwiched between said main current paths and said circumferential end, and a plurality of said dispersed current paths provided adjacent to a plurality of said current blocking sections, said dispersed current paths including at least one of said communicating current paths.

12. A vacuum interrupter according to claim 10 or 11, wherein each of said current blocking sections is a slit.

13. A vacuum interrupter according to claim 10 or 11, wherein each of said current blocking sections is made of high-resistance material such as stainless steel or ceramics.

14. A vacuum interrupter according to claim 10 or 11, wherein said communicating current path is formed between one end of said main current path corresponding to the center of said main electrode and said circumferential end portion of said main electrode electrically connected to said current dividing section.

* * * * *